US006772860B1

(12) United States Patent
Nelson

(10) Patent No.: US 6,772,860 B1
(45) Date of Patent: Aug. 10, 2004

(54) HELICOPTER ACCESS PLATFORM

(75) Inventor: Eugene R. Nelson, Florence, SC (US)

(73) Assignee: Aluminum Ladder Company, Florence, SC (US)

( * ) Notice: Subject to any disclaimer, the term of this patent is extended or adjusted under 35 U.S.C. 154(b) by 40 days.

(21) Appl. No.: 10/386,369

(22) Filed: Mar. 11, 2003

(51) Int. Cl.[7] ..... E04G 3/00
(52) U.S. Cl. ..... 182/115
(58) Field of Search ..... 182/115, 1, 19, 182/17, 113, 127, 63.1

(56) References Cited

U.S. PATENT DOCUMENTS 2,362,170 A * 11/1944 Swaisgood ..... 182/1
3,016,105 A * 1/1962 House ..... 182/149
3,670,849 A * 6/1972 Milner, Jr. ..... 182/19
3,889,778 A * 6/1975 Dotts ..... 182/17
4,620,608 A * 11/1986 Gilbreath ..... 182/17
4,787,111 A * 11/1988 Pacek et al. ..... 14/71.1
5,381,575 A * 1/1995 Silberman ..... 14/69.5
5,411,111 A * 5/1995 Greve ..... 182/17
6,145,619 A * 11/2000 Risser ..... 182/113
6,405,831 B1 * 6/2002 Daniel, III ..... 182/127
6,431,314 B1 * 8/2002 Boulanger et al. ..... 182/63.1
2003/0178253 A1 * 9/2003 Tatge et al. ..... 182/132

* cited by examiner

*Primary Examiner*—Alvin Chin-Shue
(74) *Attorney, Agent, or Firm*—Charles L. Schwab; Nexsen Pruet LLC

(57) ABSTRACT

A mobile worker platform providing access to the rotor area of a helicopter having outriggers spaced to straddle the helicopter landing gear.

12 Claims, 3 Drawing Sheets

HELICOPTER ACCESS PLATFORM

TECHNICAL FIELD

This invention relates to a rolling worker access platform facilitating servicing and repair of helicopters.

BACKGROUND OF THE INVENTION

The servicing and repair of helicopters requires a movable structure by which a servicing or repair person can obtain access to the part of the helicopter requiring service. The rotor for instance is one such area requiring inspection, servicing and repair. Stepladders could be used, however, they do not provide safe support nor do they permit sufficient lateral movement of the worker. The support structure for permitting a worker to service or repair a helicopter needs to be selectively mobile so that it can be manually moved into a rotor servicing position at either lateral side of the helicopter.

BRIEF DESCRIPTION OF THE INVENTION

A mobile worker access platform for servicing helicopter is provided which is light weight and easily positioned manually to service the helicopter. The support tower for a worker platform or floor is laterally narrower than the floor thereby providing an overhanging floor at both lateral sides of the platform. A pair of wheeled outriggers supporting the tower are spaced from one another far enough to straddle the landing gear or runners and extend beneath the fuselage of the helicopter. The tower structure between the outriggers is high enough to clear the runner supports. This construction permits the worker platform to be moved close to the helicopter with the floor extending over a side of the fuselage thereby placing the servicing person close to the rotor area. A convenient inclined stairway serves as part of the support tower for the floor of the platform and has a front outrigger secured thereto.

BRIEF DESCRIPTION OF THE DRAWINGS

One embodiment of the invention is illustrated in the drawings, in which.

DETAILED DESCRIPTION OF THE INVENTION

Figure 1:
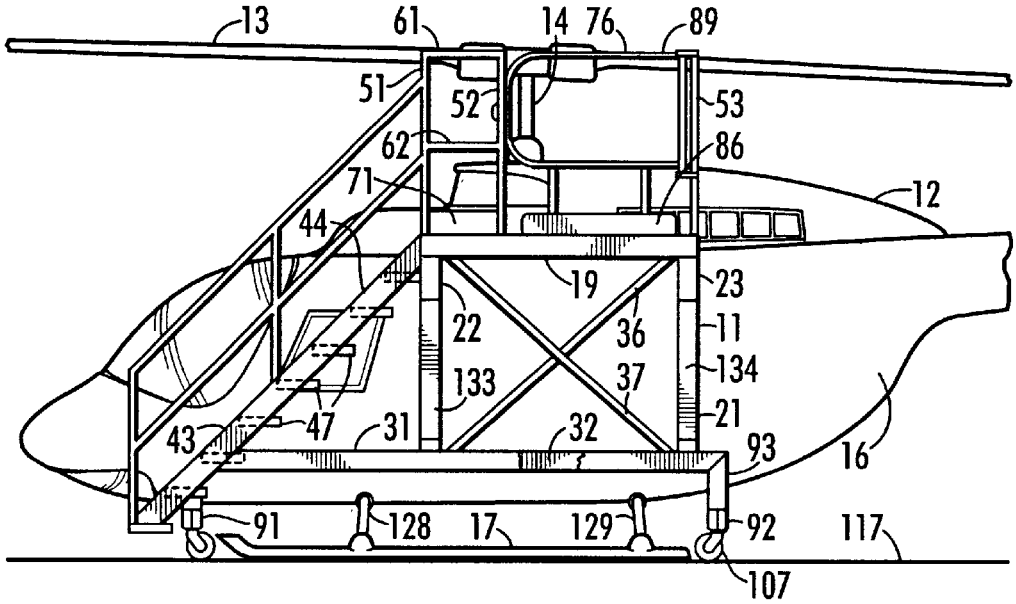
FIG. 1 is a side view of a helicopter access platform and includes an outline of a helicopter with parts of the rotor and tail boom assembly broken away.
Figure 3:
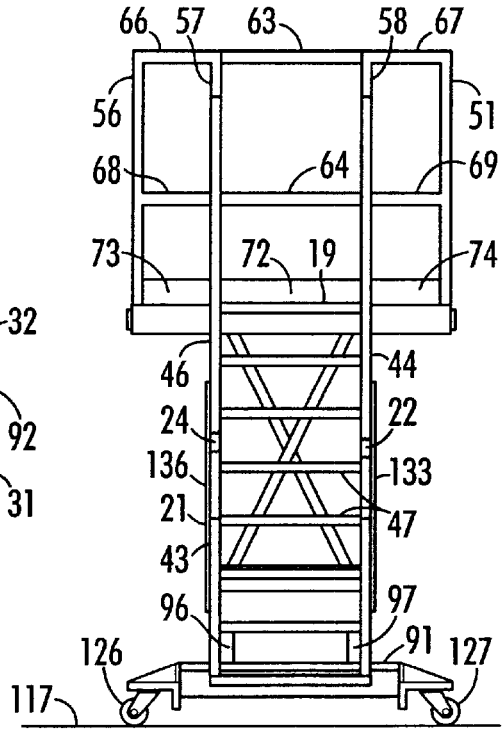
FIG. 3 is a front view of the helicopter access platform.
Figure 4:
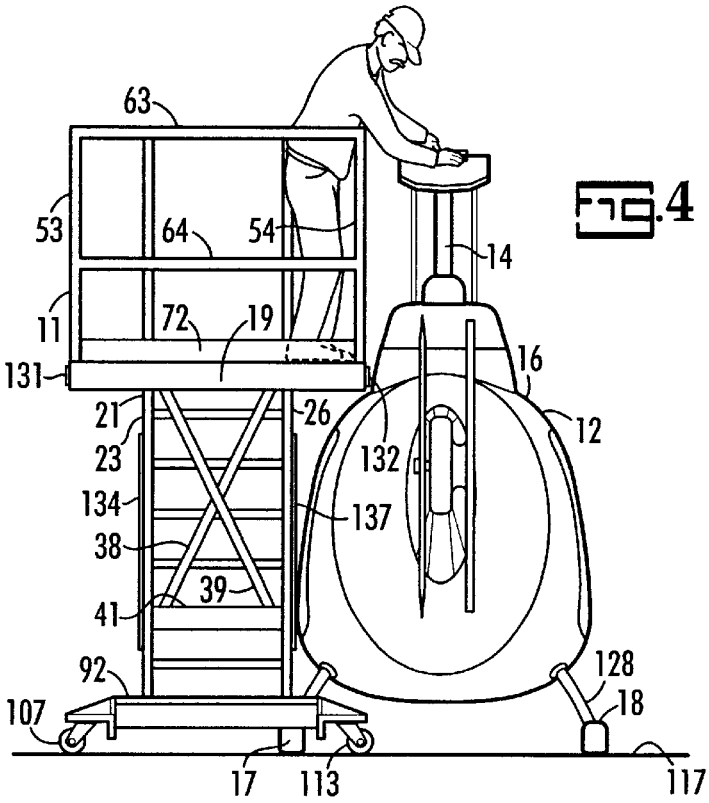
FIG. 4 is rear end view of the helicopter access platform positioned at the left side of the helicopter.
Figure 5:
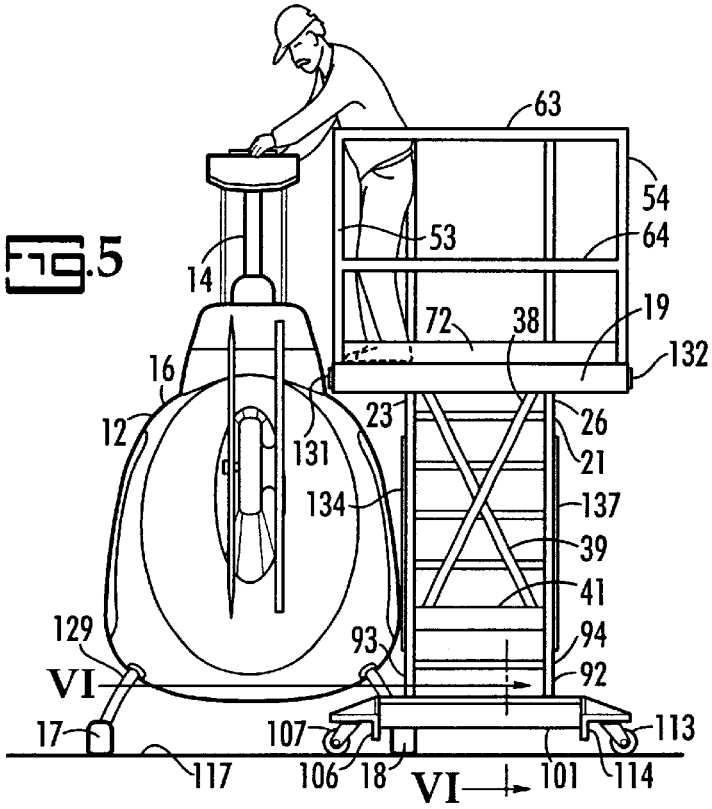
FIG. 5 is a rear view of the helicopter access platform positioned at the right side of the helicopter.

Referring to FIGS. 1 and 4, a helicopter access platform 11 is shown in a servicing position on the left hand side of a helicopter 12 which has a rotor 13 on a vertical rotor shaft 14 and a fuselage 16 supported on a pair of parallel laterally spaced ground engageable runners 17, 18. The fuselage 16 is low to the ground and may have as little as 3 decimeters of clearance. In order to service the rotor area of the helicopter 12 the platform 11 is provided with an elevated quadrilateral floor 19 supported on a support tower 21 which includes four vertical support columns 22, 23, 24, 26 having upper ends secured in supporting relation to the floor 19. The lower ends of the columns 22, 23 are secured as by welding to a fore and aft extending horizontal beam 31 and the lower ends of columns 24, 26 are secured as by welding to a fore and aft extending horizontal beam 32 which is parallel to beam 31. Cross braces 36, 37 having upper ends welded to the left side of the floor 19, as viewed in FIG. 3, and have lower ends welded to the beam 31. Similarly positioned cross braces, not shown, are welded to the right side of the floor 19 and the beam 32. As viewed in FIGS. 4 and 5 cross braces 38, 39 have their upper ends welded to the floor and their lower ends welded to a cross brace 41, the opposite ends of which are welded to the beams 31, 32. As shown in FIGS. 3, 4 and 5 the floor 19 extends laterally beyond the support columns 22, 23, 24, 26.

Figure 2:
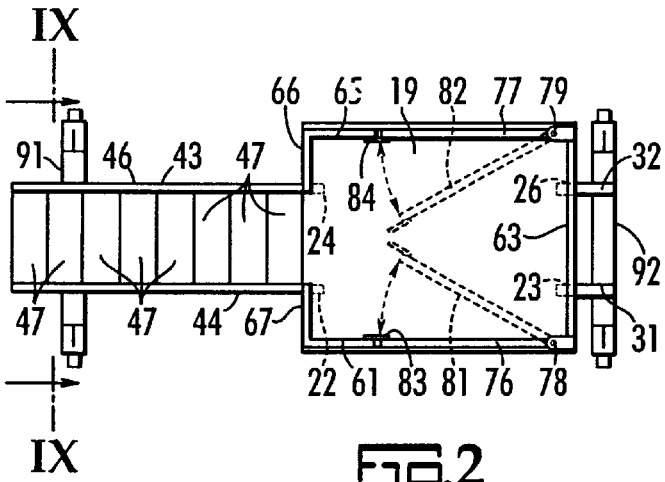
FIG. 2 is a top view of the helicopter access platform.

As shown in FIGS. 1, 2 and 3 the support tower 21 includes an inclined stairway 43 formed by a pair of parallel stair joints 44, 46 and a plurality of steps 47, the opposite ends of which are welded to the joists 44, 46. The upper ends of the stair joists 44, 46 are welded respectively, to the upper ends of the columns 22, 24 and to the front side of the floor 19. The joists 44, 46 have the same lateral spacing as the columns 22, 24, the columns 23, 26 and the support beams 31, 32. Thus the joist 44, the beam 31 and the columns 22, 23 are coplanar. Likewise the joist 43, the beam 32 and the columns 24, 26 are coplanar. The front ends of the support beams 31, 32 terminate at an angle which corresponds to the incline of the stairway joists 44, 46 thereby facilitating welding the front ends of the beams 31, 32 to the underside of the joists 44, 46.

As illustrated in FIGS. 1, 2, 3, 4 and 5, a guard railing is provided for the floor 19 which includes posts 51, 52, 53, 54 56 and rails 61, 62, 63, 64, 65, 66, 67, 68, 69. A gateway opening is provided between railing posts 52, 53 and a similar gateway opening is provided on the right hand side of the access platform 11, as viewed in FIG. 4. Toe guard panels the height of oxford shoes provided around the perimeter of the floor 19 except for the stairway opening between the railing posts 57, 58. A toe guard panel 71 has its opposite ends welded to railing posts 51, 52. A toe guard panel 72 has its opposite ends welded to railing posts 53,54. A toe guard panel 73 has its opposite ends welded to railing posts 56, 57 and a toe guard panel 74 has its opposite ends welded to rail posts 58, 51. In a like manner a toe guard panel, not shown is provided between the railing post 56 and a post at the front side of the gateway on the right hand side of the access platform. A pair of gates 76, 77, similar in construction, are provided for the left and right gateways in the safety railing. The gate 76 is pivotally connected to the railing post 53 on a vertical pivot axis 78 and the gate 77 is pivotally connected to the railing post 54 on a vertical axis 79. Both gates 76, 77 open only in a laterally inward direction. Broken lines 81 in FIG. 2 show gate 76 in a slightly open position and broken lines 82 show gate 77 in a slightly open position. Each of the gates 76, 77 can be separately opened 90 degrees to where it is parallel to guard rail 63 at the rear of the floor 19. The gates 76, 77 may be opened when the access platform is placed for servicing the helicopter 12 thereby giving the servicing person better access to the areas requiring service. Or the servicing person may step out onto the fuselage 16 if necessary. Tabs 83, 84 are provided on the gates to prevent them from being opened laterally outwardly. Each of the gates is provided with a toe guard panel. As shown in FIG. 1 a toe guard panel 86 is secured to the lower ends of vertical connectors 87, 88 which have their upper ends welded to a U-shaped component 89 of the gate 76.

The access platform 11 is supported at its front and rear by a pair of low to the ground wheeled outriggers 91, 92. The rear outrigger 92 is rigidly connected to the beams 31, 32 by studs 93, 94 and the front outrigger 91 is rigidly connected to the second step 47, from the bottom of the stairway, by short studs 96, 97, as shown in FIGS. 3 and 9.

Figure 6:
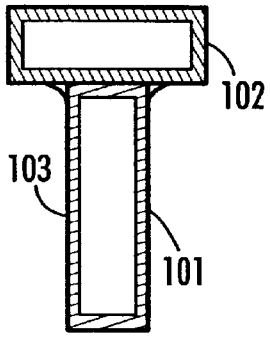
FIG. 6 is a section taken on the line VI—VI in FIG. 5.
Figure 7:
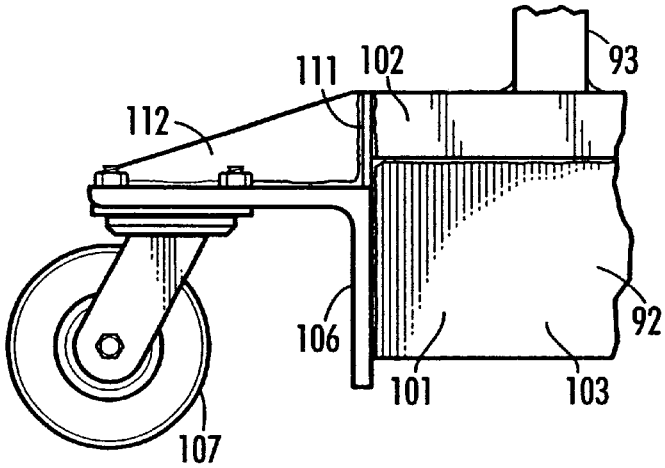
FIG. 7 is a partial rear view of an outrigger.
Figure 8:
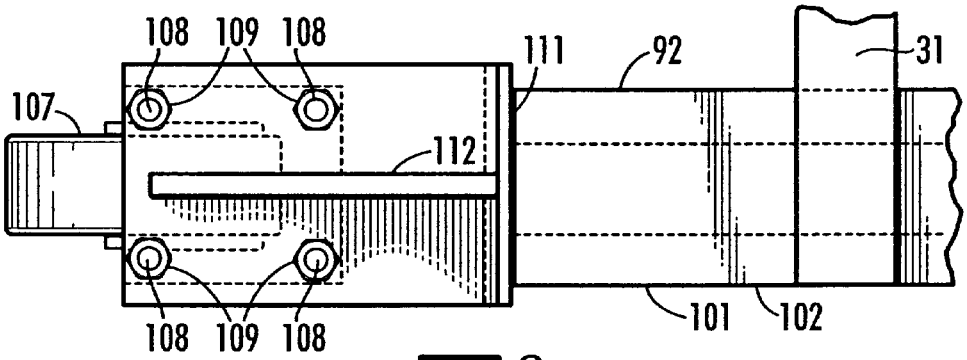
FIG. 8 is a partial top view of an outrigger.

As shown in FIGS. 1, 2, 3, 4, 5, 6, 7, and 8 the rear outrigger 92 includes a T-shaped transverse horizontal truss 101 formed by welding a hollow upper tube 102 of rectangular section to a rectangular section hollow lower tube 103 as illustrated FIGS. 6 and 7. The tube 102 is approximately twice as wide as it is high and the tube 103 is approximately three times as high as it is wide. As shown in FIGS. 7 and 8, a channel member 106 has a vertical flange welded to the lateral end of the tube 103 and has a horizontal flange to which a wheeled swivel caster 107 is secured by releaseable fasteners in the form of four threaded studs 108 and nuts 109. A small vertical plate 11 is welded to the tubes 102, 103 and the channel member 106 and a gusset 112 is welded to the plate 111 and to the horizontal flange of the channel member 106. A wheeled swivel caster 113 is mounted on a channel member 114 at the other end of the T-shaped section of the outrigger 101 in a reverse image manner. The wheels of the casters 107, 113 make contact with a support surface 117 at points approximately vertically beneath the laterally opposite edges of the floor 19.

Figure 9:
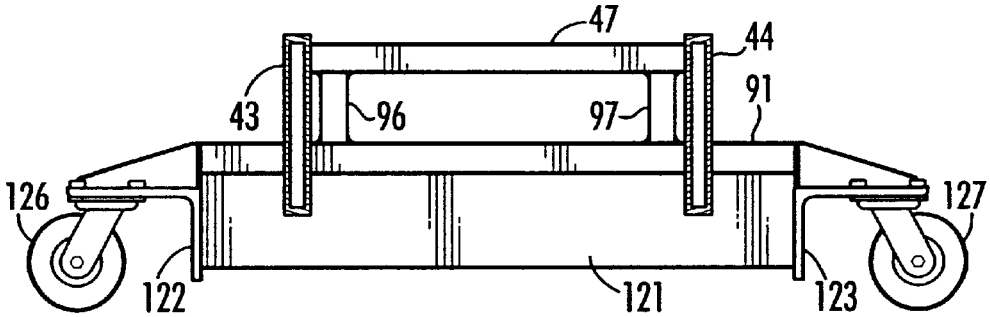
FIG. 9 is a section taken along the line IX—IX in FIG. 2.

As shown in FIGS. 3 and 9, the outrigger 91 at the front of the access platform is similar in construction to the rear outrigger 92 and has a T section truss 121 to which a pair of channel members 122, 123 are welded. A pair of wheeled swivel casters 126, 127 are mounted on the channel members 112, 123 and positioned vertically below the lateral edges of the floor 119. The swivel casters 126, 127 have manually lockage wheels to prevent movement of the access platform 11 when in a helicopter servicing position as shown in FIGS. 1, 4 and 5. The wheels of the swivel casters 107, 113 may also be selectively lockable.

The front to rear spacing of the outriggers 91, 92 is greater than the length of the runners 17, 18 so as to permit them to straddle the runner at either side of the helicopter thereby permitting the floor 19 of the access platform to be positioned close to the helicopter. The support beams 31, 32 are at a sufficient elevation to define an underside opening high enough to clear the runner or undercarriage support members 128, 129. As shown in FIGS. 4 and 5 the floor 19 extends laterally beyond the support tower 21 at a height above the fuselage 16 of the helicopter. The overhang of the floor 19 permits the service personnel close access to the rotor area which requires critical, accurate inspection and servicing. As shown in FIGS. 4 and 5 the outriggers 91, 92 extend laterally beneath the fuselage 16 to the same extent as the floor 19 extends laterally over the fuselage 16.

As illustrated in FIGS. 1, 2, 3, 4, and 5, bumper pads 131, 132 of resilient cushioning material are secured to the laterally opposite sides of the floor 19 and similar pads 113, 134, 136, 137 are secured to the columns 22, 23, 24, 26. The pads are designed and provided to prevent damage to the fuselage of the helicopter.

Practical Application

Helicopters require careful diligent servicing to insure efficient, safe operation. Servicing the rotor area of the helicopter is critical to functional operation of the helicopter. The herein disclosed access platform provides a stable floor positioned over the fuselage and close to the rotor area. The access platform is symmetrical, permitting it to be placed at either side of the helicopter. The support tower 21 for the floor 19 includes four columns 22, 23, 24 and 26 mounted on a pair of parallel longitudinally extending beams 31, 32 which have their front ends connected to an inclined stairway 43 whose upper end is secured to the floor 19. Thus the stairway serves as a fore and aft structural brace in the floor support tower 21. By aligning the columns 22, 23, the beam 31, the stringer 44 and the stud 93 in a coplanar manner and by aligning the posts 24, 26, the stringer 43, the beam 32 and the stud 93 in a coplanar manner, efficient use of materials is achieved thereby reducing weight and cost while maximizing rigidity and strength. The stairway provides a convenient support for the front outrigger 91 with a minimum amount of connecting framework. The columns, the beams, the studs, the T section members of the outrigger and the stairway are made of aluminum tubes which provide strength and low weight. The wheeled access platform is sufficiently light to permit it to be moved into and out of a servicing position by one or two servicing personnel. Its light weight enhances its air transportability which is important when the helicopters are moved to new bases of operation. The toe guard panels around the floor and the inward only swinging gates contribute to the safety of the helicopter servicing activity.

What is claimed is:

1. A mobile worker platform for servicing a helicopter of the type having a fuselage and a landing gear, comprising:

first and second parallel laterally spaced horizontal beams extending fore and aft at the same elevation presenting front and rear ends, a floor having a front side, a rear side and laterally opposite sides, a first pair of vertical support columns between said first beam and said floor, said first pair of support columns being spaced from one another in a fore and aft direction, a second pair of vertical support columns between said second beam and said floor, said second pair of support columns being spaced from one another in a fore and aft direction, said floor having an overhand extending laterally beyond said support columns and beams in both lateral directions and said parallel beams extending forward a substantial distance from said support columns and said floor, a fore and aft extending inclined stairway rigidly connected at its lower front end to said front ends of said beams and having it upper rear end rigidly secured to the front side of said floor, said stairway being sufficiently narrow in lateral width to not extend laterally beyond said support columns, a first horizontal laterally extending outrigger rigidly secured in supporting relation to said rear ends of said beams and having opposite lateral ends positioned a substantial lateral distance from said beams and vertical columns, a second horizontal laterally extending outrigger rigidly secured in supporting relation to said front end of said stairway and having opposite lateral ends positioned a substantial lateral distance from said beams and stairway and a wheel on each of the laterally opposite ends of said outriggers, said wheels being positioned laterally at least as far as said overhang of the associated lateral side of said floor.

2. The worker platform of claim 1 wherein said stairway includes a pair of jousts coplanar, respectively, with said first and second beams.

3. The worker platform of claim 2 wherein said first and second pairs of columns are coplanar, respectively, with said first and second beams.

4. The worker platform of claim 1 wherein said outriggers are spaced from one another in a fore and aft direction a sufficient distance to permit the landing gear at one side of a helicopter to be disposed there between when said worker platform is placed in a servicing position alongside said helicopter.

5. The worker platform of claim 4 wherein said outriggers are sufficiently low to permit them to extend unimpeded beneath said fuselage of said helicopter.

6. The worker platform of claim 1 and further comprising a guard railing around said floor having an opening for stairway access to said floor.

7. The worker platform of claim 6 wherein said guard railing includes a gate at each of said laterally opposite sides of said floor.

8. The worker platform of claim 7 wherein said gates open only laterally inward.

9. The worker platform of claim 8 wherein said guard railing includes toe guard panels near said floor.

10. The worker platform of claim 1 wherein said wheels are casters.

11. The worker platform of claim 10 wherein at least two of said casters are lockable.

12. The worker platform of claim 1 wherein said floor and vertical columns are provided with bumper pads at their laterally opposite sides for preventing damage to said helicopter fuselage.

* * * * *